United States Patent [19]

Sumikawa

[11] 4,217,677

[45] Aug. 19, 1980

[54] APPARATUS FOR PREVENTING TRANSMISSION OF VIBRATION OF A VIBRATION MACHINE

[75] Inventor: Satoshi Sumikawa, Hiroshima, Japan

[73] Assignee: Kure Tekko Company Ltd., Japan

[21] Appl. No.: 959,923

[22] Filed: Nov. 13, 1978

[30] Foreign Application Priority Data

Mar. 13, 1978 [JP] Japan ..... 53-32414[U]
May 8, 1978 [JP] Japan ..... 53-62016[U]

[51] Int. Cl.[2] ..... B25G 1/02

[52] U.S. Cl. ..... 16/119; 403/5; 74/551.9; 173/162 H

[58] Field of Search ..... 173/162, 162 H, 139; 74/551.9; 403/5; 16/116 R, 119, 111 R; 267/137, 113; 248/631

[56] References Cited

U.S. PATENT DOCUMENTS

| | | | |
|---|---|---|---|
| 436,978 | 9/1890 | Hoyt | 74/551.9 |
| 445,914 | 2/1891 | Naterson | 74/551.9 |
| 578,020 | 3/1897 | Morse | 16/119 |
| 587,388 | 8/1897 | Conard | 74/551.9 UX |
| 775,863 | 11/1904 | Smith | 16/119 X |
| 972,548 | 10/1910 | Levedahl | 173/162 X |
| 2,061,806 | 11/1936 | Noble | 16/111 R X |

FOREIGN PATENT DOCUMENTS

| | | | |
|---|---|---|---|
| 7506 | of 1897 | United Kingdom | 74/551.9 |

*Primary Examiner*—Andrew V. Kundrat
*Attorney, Agent, or Firm*—Connolly and Hutz

[57] ABSTRACT

An apparatus for preventing transmission of vibration of a vibration machine to the hands of an operator includes a vibration-absorbing action of an elastic air bag fitted as a grip to the vibration machine.

6 Claims, 12 Drawing Figures

APPARATUS FOR PREVENTING TRANSMISSION OF VIBRATION OF A VIBRATION MACHINE

BACKGROUND OF THE INVENTION

This invention relates to an apparatus for preventing transmission of vibration which absorbs the vibration occuring at the grip section of a vibration machine such as a chain-saw, a rock drill, a motorcycle, electric hair clippers or an electric shaver and minimizes the transmission of the vibration to the hands.

Machines in general that cause various vibration such as a chain-saw, a rock drill, vibrate strongly as a whole as soon as they are run. If these machines are operated by hand, the strong vibration is transmitted to the hands and into the body of an operator so that he is apt to suffer from various diseases. In fact, this strong vibration is a direct cause of the so-called "Raynaud's disease" which occurs in a user of a machine causing vibration.

In practice, a rubber material has conventionally been secured to the grip of the machine, but it has failed to provide sufficient prevention of transmission of the vibration.

SUMMARY OF THE INVENTION

The present invention is directed to an apparatus for preventing transmission of vibration which is capable of effectively preventing the vibration occurring at the grip section of a vibration machine from being transmitted to the hands of an operator in comparison with the conventional vibration-absorbing material such as a rubber.

It is another object of the present invention to provide a vibration transmission preventing apparatus which is collapsible to facilitate transportation and storage.

It is still another object of the present invention to provide a vibration transmission preventing apparatus which is free from local deformation.

It is a further object of the present invention to provide a vibration transmission preventing apparatus which can be easily detachably mounted to the grip section of a vibration machine.

It is further object of the present invention to provide a vibration transmission preventing apparatus which is capable of adjusting the vibration-absorbing ability to the most optimum level.

These objects, features and advantages of the invention will become more apparent from the following detailed description taken in conjunction with the accompanying drawings.

DETAILED DESCRIPTION

An embodiment of the present invention will now be explained by referring to FIGS. 1 and 2.

Figure 1:
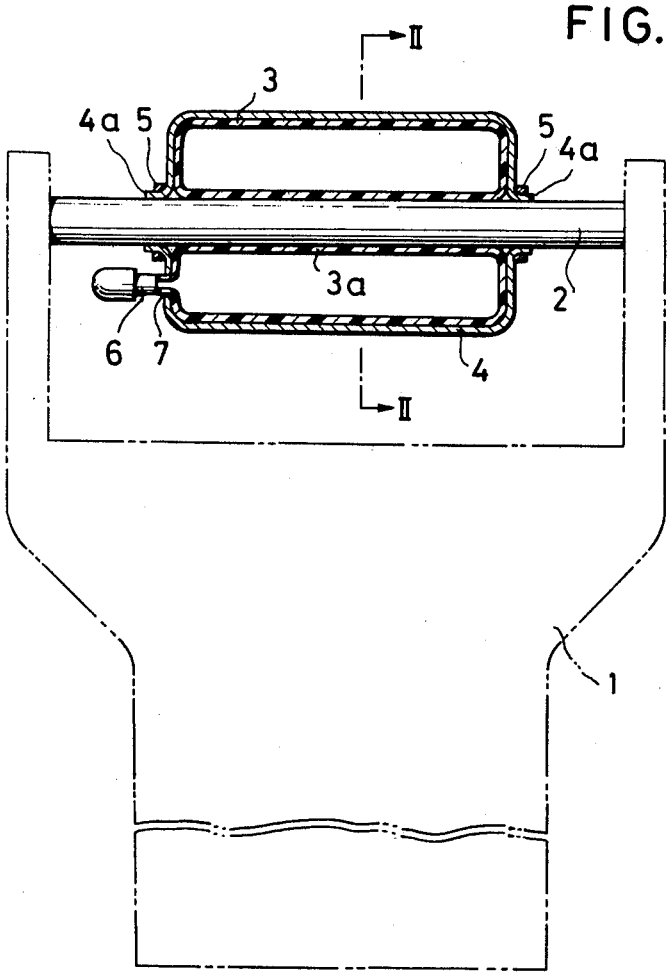
FIG. 1 is a sectional view of the vibration transmission preventing apparatus as an embodiment of the present invention.
Figure 2:
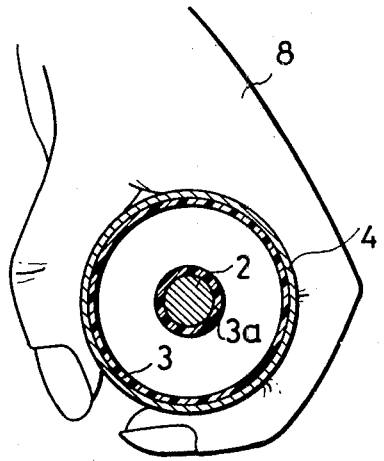
FIG. 2 is a sectional view taken along line II—II of FIG. 1 and showing the user's hand.

In FIG. 1, the reference numeral 1 represents a vibration machine causing vibration such as a chain-saw or a rock drill and numeral 2 designates a grip as the handle base portion of the machine 1. Numeral 3 is an air bag which is made of an elastic material such as a rubber or a synthetic resin and its outer shape is cylindrical as shown in FIG. 2. A through-cylinder section 3*a* is provided along the center axis of the air bag and is fitted into the grip 2. Numeral 4 represents a cylindrical cover made of a flexible material such as cloth or leather, which covers the outside of the above-mentioned air bag 3. Both side ends 4*a*, 4*a* of the cylindrical cover 4 have a reduced diameter in the direction of the grip 2 and are secured to the grip 2 by means of a fastener 5. Reference numeral 6 represents an air supply valve for the air bag 3, the tip of which protrudes outward beyond a small hole 7 formed on the cover 4.

Next, the explanation will be given on the mode of use of the above-described vibration transmission preventing apparatus.

In using the machine 1, the compressed air is charged from the air supply valve 6 whereby the air bag 3 is inflated and is brought into pressure contact with the inner surface of the cover 4. The hardness of the cover 4 is kept at the most suitable value by adjusting the quantity of the air fed into the air bag 3.

The machine 1 is used while the outside of the cover 4 is gripped by the hands 8. The vibration occurring on the machine 1 and transmitted to the grip 2 is mitigated by the air inside the air bag 3 so that hardly any vibration is transmitted to the hands. Hence, the operator can continue the work over an extended period without being applied with the vibration.

As mentioned above, the vibration transmission preventing apparatus for the grip of the machine has the construction wherein the elastic cylindrical air bag 3 with the through-cylinder 3*a* along its center axis is fitted to the grip 2 of the machine, the outside of which is covered with the inextensible flexible cylindrical cover 4, both side ends 4*a*, 4*a* of the cover 4 being fastened to the grip 2 of the machine while their diameter is reduced in the direction of the handle and the tip of the air supply valve 6 of the air bag 3 is allowed to protrude through the small hole 7 of the cover 4. The apparatus is used by charging the compressed air into the air bag 3 and whenever necessary, the air is discharged from the air bag so as to diminish the size of the bag for easy transportation and storage. This provides a great practical effect in addition to its substantially perfect absorption of the mechanical vibration.

Though the above-described embodiment uses the cylindrical air bag for the prevention of the vibration transmission, it is not always necessary to use the cylindrical air bag for the purpose of preventing the vibration transmission. Namely, as can be seen in embodiments shown in FIGS. 3 through 9, the transmission of vibration may also be prevented by the use of a plurality of arcuate air bags.

Next, the explanation will be given on the vibration transmission preventing apparatus of the invention together with a spring type vibration transmission preventing mechanism that is interposed between the vibration transmission preventing apparatus of the invention and the vibration machine.

Figure 3:
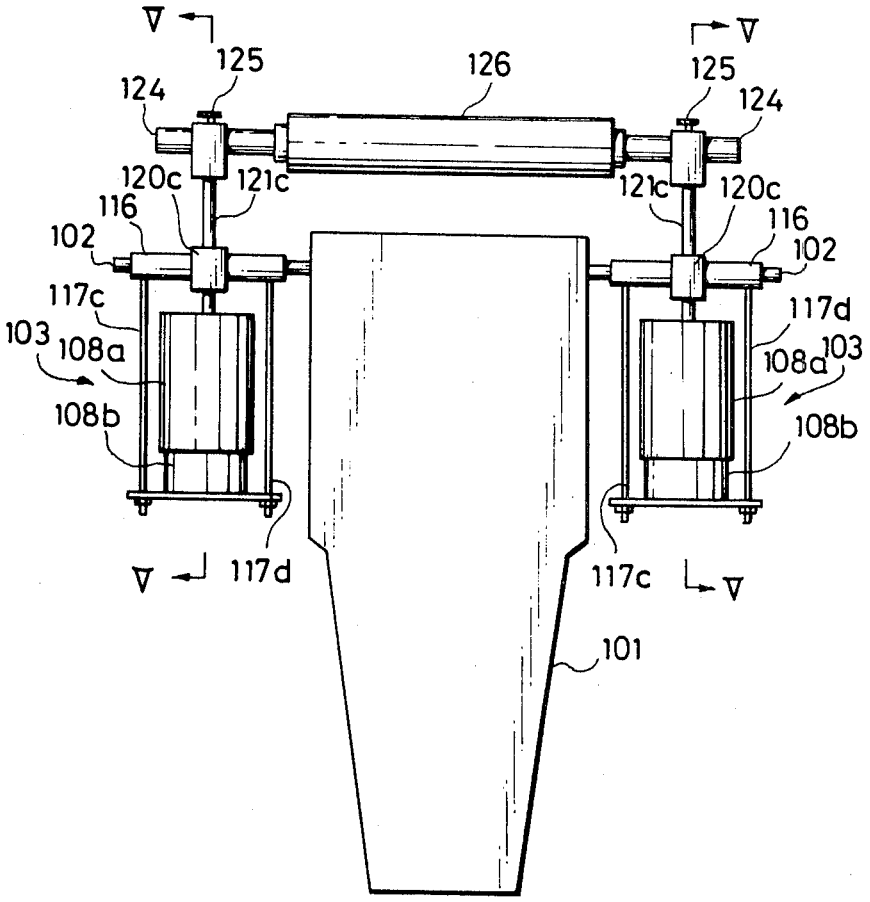
FIG. 3 is a front view of the rock drill to which the vibration transmission preventing apparatus of another embodiment of the invention is fitted.
Figure 4:
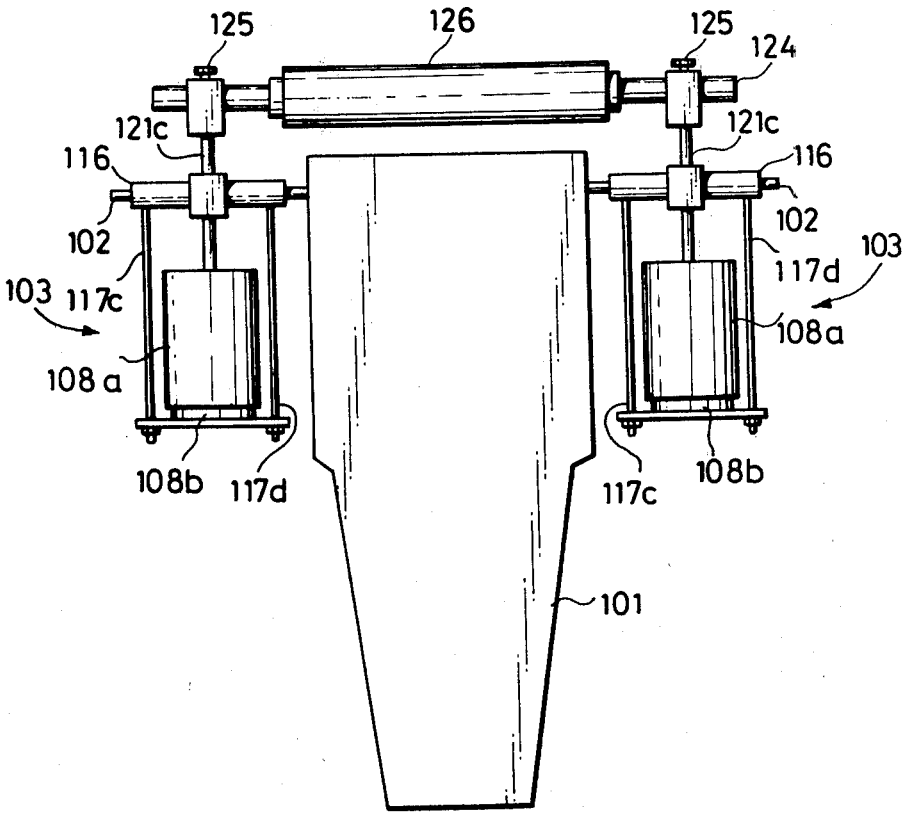
FIG. 4 is a front view showing the operative condition of the rock drill of FIG. 3.

In FIGS. 3 and 4, reference numeral 101 designates the vibration machine and numerals 102, 102 are arm rods that are fitted protrusively to the upper portion on both sides of the vibration machine 101. Numerals 103, 103 represent a vibration-absorbing mechanism (spring type vibration transmission preventing apparatus) that is fitted to each arm rod 102 and secured by a fixing member 134.

Figure 5:
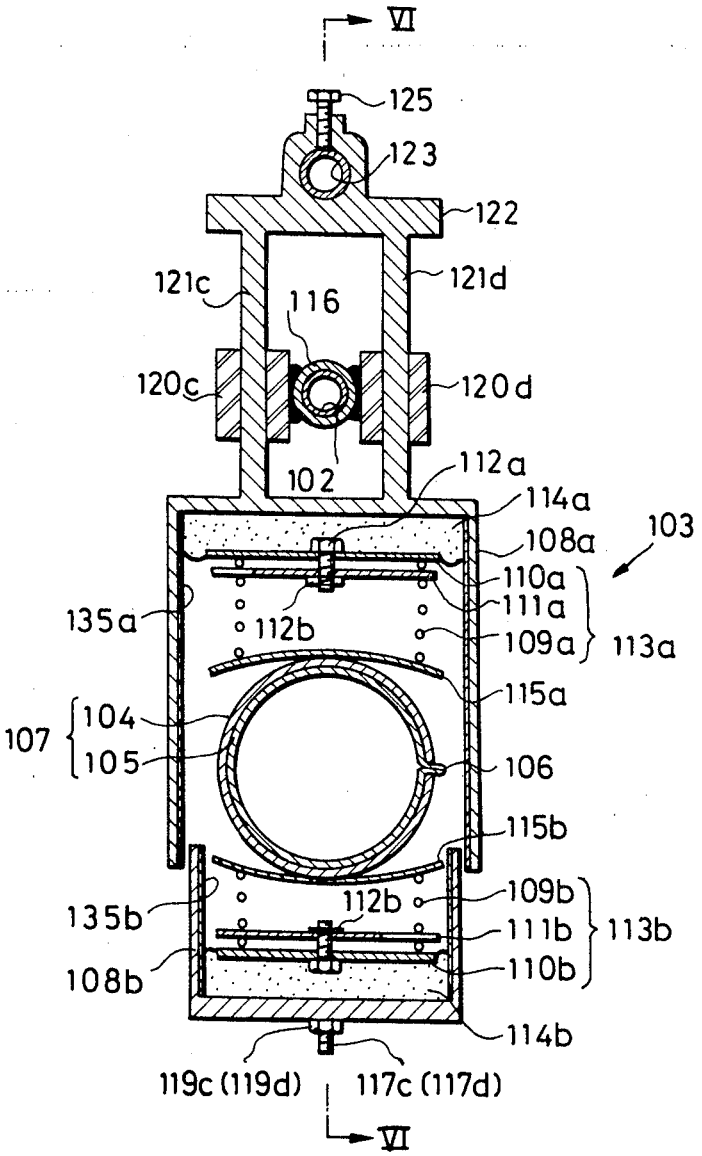
FIG. 5 is a sectional view taken along line V—V of FIG. 3.
Figure 6:
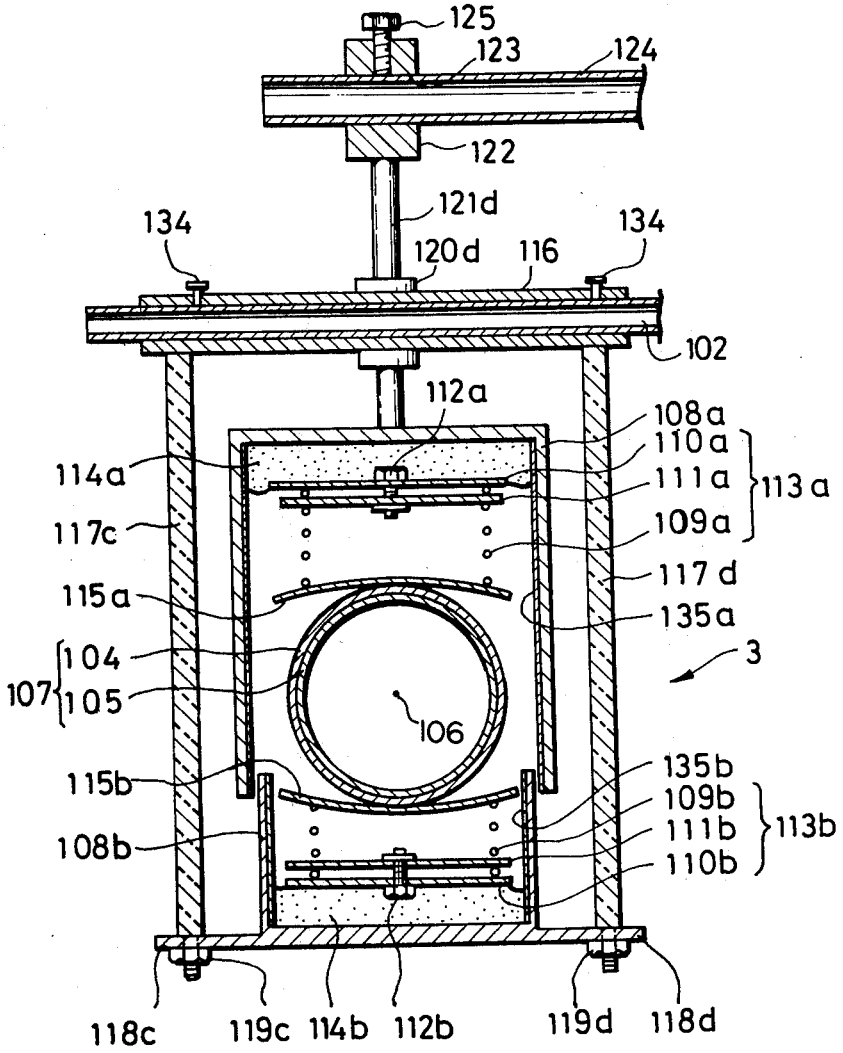
FIG. 6 is a sectional view taken along line VI—VI of FIG. 5.

This vibration-absorbing mechanism 103 will be explained in detail with reference to FIGS. 5 and 6. A spherical outer bag 104 made of an inextensible flexible material such as leather incorporates therein a spherical inner rubber bag 105. When the compressed air is charged from a valve 106, the outer bag 104 is inflated into a ball 107.

Numerals 108*a* and 108*b* represent upper and lower cuplike cylindrical members, respectively, and rubber layers 135*a* and 135*b* are disposed on their inner surface for the vibration absorption and insulation. The rubber layers can be fitted to each other. Numerals 109*a* and 109*b* represent coil springs, respectively, first single turns of which is interposed between substrates 110*a*, 110*b* and intermediate plates 111*a*, 111*b* and fastened and secured by bolts and nuts 112*a*, 112*b*, thereby forming buffers 113*a*, 113*b*.

Sponges 114*a*, 114*b* are disposed on the inside of the base plate of the cylindrical members 108*a*, 108*b* and the substrates 110*a*, 110*b* of the buffers 113*a*, 113*b* are positioned to interpose the sponges between the base plates and the substrates, respectively. Receiving trays 115*a*, 115*b* are positioned on the side of the coil springs 109 of the buffers 113*a*, 113*b* to sandwich the ball 107 between both receiving trays 115*a* and 115*b*. Numeral 116 represents a fitting pipe into which the aforementioned arm rod 102 is inserted. Numerals 117*c* and 117*d* are support rods that are secured to the fitting pipe 116 and extend therefrom. The lower end of these support rods 117*c* and 117*d* are inserted into lug 118*c*, 118*d* of the lower cylindrical member 108*b* and then secured by nut 119*c*, 119*d*. Slide bearings 120*c*, 120*d* movable in the vertical direction are disposed on both sides at the center of the fitting pipe 116 and sliding rods 121*c*, 121*d* implanted and secured onto the upper cylindrical member 108*a* are inserted into these slide bearings 120*c*, 120*d*, respectively. A coupler 122 is disposed at the upper end of the sliding rods 121*c*, 121*d* and has a hole 123 formed thereon. A main shaft 124 as the grip base portion of the vibration machine is inserted into this pivot hole 123 and secured by a lock bolt 125. Each of the vibration-absorbing nechanisms 103, 103 is constructed in the above-mentioned manner.

A grip 126 as a vibration transmission preventing apparatus (second vibration-absorbing mechanism) is fitted to the main shaft 124 which transversely bridges these vibration-absorbing mechanism. The grip 126 will be explained in further detail with reference to FIGS. 7 through 9.

Figure 7:
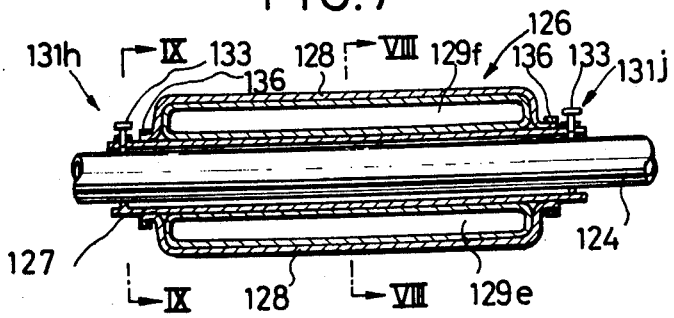
FIG. 7 is a partial sectional view of the vibration transmission preventing apparatus shown in FIGS. 3 and 4.
Figure 8:
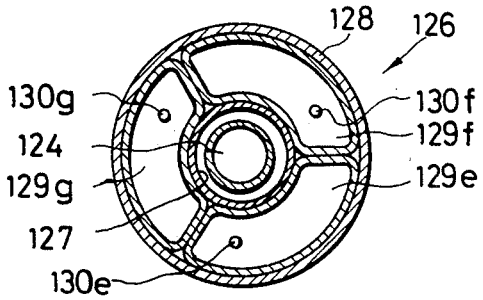
FIG. 8 is a sectional view taken along line VIII—VIII of FIG. 7.
Figure 9:
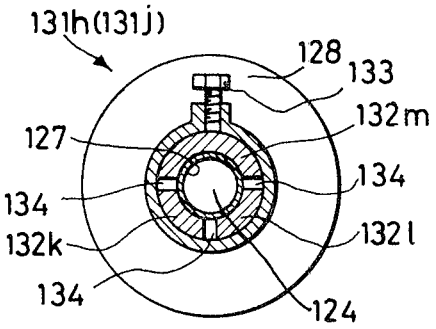
FIG. 9 is a sectional view taken along line IX—IX of FIG. 7.

In FIGS. 7 through 9, numeral 127 represents an outer cylinder fitted to the main shaft 124; numeral 128 is an inextensible flexible cylindrical cover covering the cylinder 127; and numerals 129*e*, 129*f* and 129*g* are air bags disposed between the cylindrical cover 128 and the outer cylinder 127. These members together form the grip 126.

Each air bag of 129*e*, 129*f*, 129*g* extends in the longitudinal direction of the main shaft 124 as shown in FIG. 7 and its section is shaped in an arcuate form as shown in FIG. 8. Numerals 130*e*, 130*f* and 130*g* represent air supply valves disposed on the air bags 129*e*, 129*f* and 129*g*, respectively, and numerals 136, 136 represent bands which fastens both end portions of the inextensible flexible cylindrical cover 128 around the outer circumference at both ends of the outer cylinder 127.

Bearing sections 131*h*, 131*j* function as fastener means and are provided close to both ends of the inner surface of the outer cylinder 127. Each of the bearing sections 131*h* and 131*j* consists of two stationary arcuate protuberances 132*k*, 132*l* which are formed protrusively at both ends of the inner surface of the outer cylinder 127 to space apart from each other and one moving arcuate plate 132*m* which is separate from the outer cylinder 127 and can be secured to the main shaft 124 by a bolt 133. These stationary arcuate protuberances 132*k*, 132*l* and the moving arcuate plate 132*m* are aligned in a circumferential state and gaps 134 are formed between these three members, respectively, so that the inner surface of these three members can be brought into intimate contact with the main shaft 124. Numeral 133 is a lock bolt. The lock bolt 133 is screwed at both ends of the outer cylinder 127 and the tip of this lock bolt 133 strikes the moving arcuate plate 132*m*. Accordingly, when the main shaft 124 is inserted into the outer cylinder 127 and the lock bolt 133 is then screwed, the moving arcuate plate 132*m* is brought into pressure contact with the main shaft 124, thereby fixing the outer cylinder 127 to the main shaft 124.

Next, the explanation is given how the vibration transmission preventing apparatus having the above-mentioned construction can be assembled and how it operates.

The apparatus as a whole can be assembled by fitting first the fitting pipe 116 of the vibration-absorbing mechanism 108 into the arm rod 102 of the vibration machine 101, then inserting the main shaft 124 into the pivotal hole 123, the outer cylinder 127 and into the pivotal hole 123 and thereafter screwing the lock bolts 125, 125 and the lock bolts 133, 133. These components can be easily disassembled from the vibration machine 101 by reversing the above-mentioned assembly procedures.

When the vibration machine 101 is operated while the grip 126 is being gripped, the vibration machine 101 causes vibration. Due to this vibration the sliding rods 121*c*, 121*d* slide up and down inside the slide bearings 120*c*, 120*d*, thereby expanding and compressing the coil springs 109*a*, 109*b* as well as the ball 107. This action absorbs the majority of the vibration. A part of the remaining vibration is absorbed by the resiliency of the sponges 114*a*, 114*b* and the rubber layers 135*a*, 135*b* while the rest are transmitted to the main shaft 124 through the sliding rods 112*c*, 112*d*. Though the vibration transmitted to the main shaft 124 reaches the grip 126, it is absorbed by the resiliency of the air in the air bags 129*e*, 129*f*, 129*g* and the proper vibration-absorbing action of the cylindrical cover 128. Hence, scarcely any vibration is transmitted to the hands of the operator holding the grip 126, that is to say, the operator would feel that he only pushes the grip 126.

As mentioned above in the vibration absorbing device in the manual vibration machine in this embodiment, the ball 107 filled with therein the high pressure air is interposed between the upper and lower buffers 113*a*, 113*b* consisting of the coil springs 109*a*, 109*b*, and the cup-like cylindrical members 108*a*, 108*b* cover these buffers 113*a*, 113*b* via the sponges 114*a*, 114*b*, respectively, thereby forming the vibration absorbing mechanism 103. Each lower cylindrical member 108*b* of each of the two vibration absorbing mechanisms 103, 103 is connected to the fitting pipes 116, 116 fitted and secured respectively to the right and left arm rods 102, 102 of the vibration machine 101 via the support rods 117*c*, 117*d*, and the sliding rods 121*c*, 121*d* implanted onto the upper cylindrical member 108*a* are allowed to extend upward through the slide bearings 120*c*, 120*d* provided to the fitting pipe 116. Both ends of the main shaft 124 are secured to the upper end of the right and left sliding rods, and the arcuate air bags 129*e*, 129*f*, 129*g* which are divided along the bus line of the shaft are arranged to the outer cylinder 127 fitted to the outside of the main shaft 124 to thereby provide the grip 126. In addition, both ends of the outer cylinder 127 are fastened to the main shaft 124 via the moving arcuate plate 132*m* which can slide on the main shaft 124.

When the vibration machine 101 is pushed while its grip 126 is being held, its vibration is transmitted to the grip 126 via the arm rod 102, the fitting pipe 116, the sponge 114*b*, the coil spring 109*b*, the ball 107, the coil spring 109*a*, the sponge 114*a*, the sliding rods 121*c*, 121*d*, the main shaft 124, the outer cylinder 127 and the air bags 129*e*, 129*f* and 129*g*, In other words, the effective combination of the coil springs with the air cushion can provide excellent vibration absorbing effect. In addition, as the pushing force becomes greater, the resiliency of the coil springs and the air pressure in the ball become greater, thereby enabling the effective work. Since the air bag is divided into the several segments along the bus line of the outer cylinder, it is free from the local deformation arising from the uneven distribution of the air.

Incidentally, the vibration absorbing mechanisms 103, 103 are not always necessary because the grip 126 as the vibration transmission preventing apparatus alone can sufficiently prevent the transmission of vibration.

In this embodiment, the grip 126 (vibration transmission preventing apparatus) assembled in a unit is inserted slidably into the main shaft 124 supported onto the vibration absorbing mechanisms 103, 103 and then secured by the lock bolts 133, 133. It is, therefore, possible to easily fit and remove the grip 126 to and from the main shaft 124.

Figure 10:
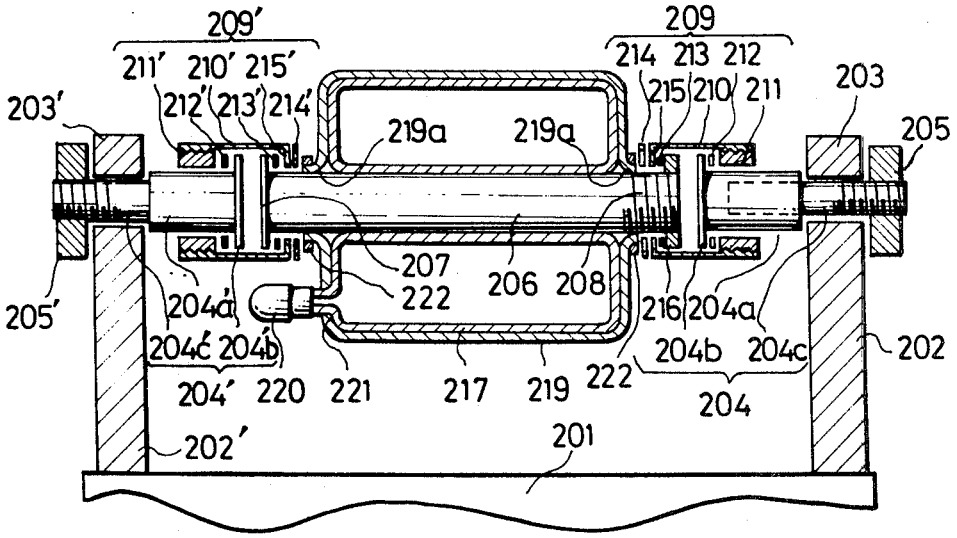
FIG. 10 is a sectional view of the vibration transmission preventing apparatus as still another embodiment of the present invention.
Figure 11:
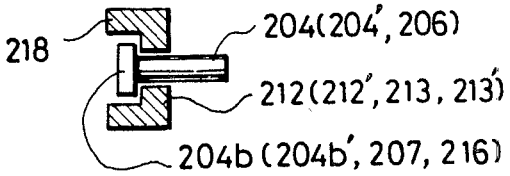
FIG. 11 is a sectional view showing another example of the rubber washer shown in FIG. 10.

The foregoing embodiments illustrate some examples wherein the transmission of vibration of the vibration machine to the hands of the operator is prevented by means of the vibration absorbing action of the air bags alone or by the vibration absorbing action of the springs in combination with the air bags. However, the present invention is not specifically restricted to these constructions. Namely, the transmission of vibration of the vibration machine to the hands of the operator may be prevented by the use of a vibration absorbing mechanism comprising the air bags and a resilient member such as a rubber. FIGS. 10 and 11 show an example of such embodiment. Hence, the explanation in detail will be given by referring to these drawings.

In FIG. 10, numeral 201 represents a vibration machine and numerals 202, 202' are the support arms that are formed integrally and protrusively at the upper end on both sides of the vibration machine 201.

Holes 203, 203' are bored on the support arms 202, 202', respectively, and numerals 204, 204' are support shafts. Each support shaft 204 has a large diameter shaft portion 204*a*, a flange 204*b* formed on the outer circumference at one end of the large diameter shaft portion 204*a* and a small diameter shaft portion 204*c* at the other end of the large diameter shaft portion 204*a* concentrically therewith. The support shaft 204' has the same construction as the support shaft 204.

The small diameter shaft portion 204*c* of the support shaft 204 penetrates through the hole 203 from the opposed side of the support arms 202, 202 towards the other side. A nut 205 as a fastening means is screwed to the protrusive portion of this small diameter shaft portion 204*c* which prevents the support shaft 204 from slipping-off from the support arm 202. The support shaft 204' is fitted to the support arm 202' in the same manner.

Numeral 206 represents a bag-fitting shaft as the base portion of the grip of the vibration machine. A flange 207 is formed protrusively on the outer circumference at one end of the bag-fitting shaft 206 and a screwed portion 208 is formed on the outer circumference at the other end of this shaft 206. The bag-fitting shaft 206 is shorter than the length between the support shafts 204 and 204', and is connected to the support shafts 204, 204' via vibration absorbing mechanisms 209, 209' as the first vibration transmission preventing apparatus.

The vibration absorbing mechanism 209 consists of a connection cylinder 210, a fixing ring 211 and rubber washers 212, 213, 214. A flange 215 is formed integrally at one end of the connection cylinder 210, which protrudes inwardly. One end of the bag-fitting shaft 206 is inserted into this flange 215. The flange 215 is prevented from slipping off from the bag-fitting shaft 206 by means of the nut 216 that is screwed to the threaded portion 208 of the bag-fitting shaft 206. The fixing ring 211 is fitted to the large diameter shaft portion 204*a* of the support shaft 204 and is prevented from slipping off from the support shaft 204 by the flange 204*b*. The fixing ring 211 is screwed onto the inner surface at the open end of the connection cylinder 210. The rubber washer 212 is interposed between the flange 204*b* and the fixing ring 211, and the rubber washer 213 between flange 215 and the nut 216. The rubber washer 214 is interposed between an air bag 217 as the second vibration transmission preventing apparatus and the flange 215. The vibration absorbing mechanism 209' has the same construction as the mechanism 209 except that the rubber washer 213' is interposed between the flanges 215' and 207. Hence, the explanation is hereby omitted with the symbol (') representing the like constituent members.

The bag-fitting shaft 206 is connected to the support shafts 204, 204' via these vibration absorbing mechanisms 209, 209' so that it is capable of moving to the right and left as seen in the drawing. However, the screwing degree of the fixing rings 211, 211' to the connection cylinders 210, 210' is adjusted such that the bag-fitting shaft 206 is not brought into direct contact with the support shaft 204, 204'. In the practical use, it is desirable to adjust the screwing degree of the fixing rings 211, 211' to the connection cylinders 210, 210' so that the rubber washers 212, 212' are interposed between the flanges **204*b*, 204*b*' and the fixing rings 211, 211', the rubber washer 213 between the flange 215 and the nut 216 and the rubber washer 213' between the flanges 215' and 207**.

Alternatively it is advisable to provide a cylinder section 218 covering the outer circumference of the flange or the nut as shown in FIG. 11 in order to prevent the direct contact between the flange **204*b* and the nut 216 vs. the connection cylinder 210 and the direct contact between the fixing ring 211 vs. the support shaft 204 and the direct contact between the flange 215 vs. the bag-fitting shaft 206. Similarly, it is also advisable to furnish the rubber washers 212', 212' with a cylindrical part 218 covering the outer circumference of the flange in order to prevent the direct contact between the connection cylinder 210' vs. the flanges 204*b*', 207, the direct contact between the flange 215' vs. the bag-fitting shaft 206 and the direct contact between the fixing ring 211' vs. the support shaft 204'. These arrangements enable to prevent more effectively the transmission of vibration from the support shafts 204, 204' to the bag-fitting shaft 206**.

The air bag 217 is made of a soft material such as a synthetic resin into a cylindrical form, and is fitted to the outer circumference of the bag-fitting shaft 206.

A cylindrical cover 219 made of a soft material such as cloth, leather covers the outer circumference of the air bag 217. The diameter at both ends **219*a*, 219*b* of this cylindrical cover 219 is diminished in the direction of the connection shaft 206 and both ends are connected and fastened to the connection rod 206 by means of bands 222, 222. Numeral 220 designates an air supply valve for the air bag 217 and its tip protrudes outwardly through a small hole 221 formed on the cover 219**.

The action of the vibration transmission preventing apparatus having the above-mentioned construction is as follows.

When the compressed air is charged into the air bag 217 through the air supply valve 220, the air bag 217 is inflated and brought into pressure contact with the inner surface of the cover 219. The hardness of the cover 219 is kept at an optimum level by adjusting the air quantity to be charged into the air bag 217.

Thereafter, the apparatus is used while the outside of the cover 219 is gripped by hands. When the vibration machine 201 is run under this condition, the machine 201 causes vibration. This vibration force is transmitted to the support shafts 204, 204' through the support arms 202, 202'. A part of the vibration force is absorbed by the buffer action of the rubber washers 212, 213, 212', 213' while a part of the rest is transmitted to the bag-fitting shaft 206.

The vibration force transmitted to the bag-fitting shaft 206 is mitigated by the air inside the air bag 217, thereby preventing the vibration from reaching the hands of the operator.

In this embodiment, the bag-fitting shaft 206 is connected to the support arms 202, 202' via the support shaft 204, 204' fitted detachably to the support arms 202, 202' and via the vibration absorbing mechanisms 209, 209' fitted detachably to the support shafts 204, 204' and to the connection shaft 206. Accordingly, the air bag 217 can be removed from the vibration machine 201 without taking it away from the bag-fitting shaft 206 and can be assembled easily. Moreover, a part of the vibration force is absorbed by the vibration absorbing mechanisms 209, 209' as the first vibration transmission preventing apparatus whereby only a part of the vibration transmitted to the support shaft 204, 204' is transmitted to the bag-fitting shaft 206. Hence, the vibration force transmitted to the bag-fitting shaft 206 becomes small, after all. As a result, the air bag 217 completely absorbs the rest of the vibration force and scarcely any vibration force is transmitted to the hands of the operator.

As explained in the foregoing paragraph, the air bag as the vibration transmission preventing apparatus of the present invention may be used either in combination with other vibration transmission preventing apparatuses or alone. When the air bag is used in combination with other vibration transmission preventing apparatus, it is possible to prevent substantially perfectly the vibration of the vibration machine from being transmitted to the hands of the operator. Depending on the size of the vibration machine, the air bag alone can prevent the transmission of vibration substantially perfectly.

The air bag as the vibration transmission preventing apparatus of the present invention can be applied not only to the above-mentioned rock drill or the chain-saw but also to electric hair clippers, an electric shaver or a grip of a motor-cycle.

Figure 12:
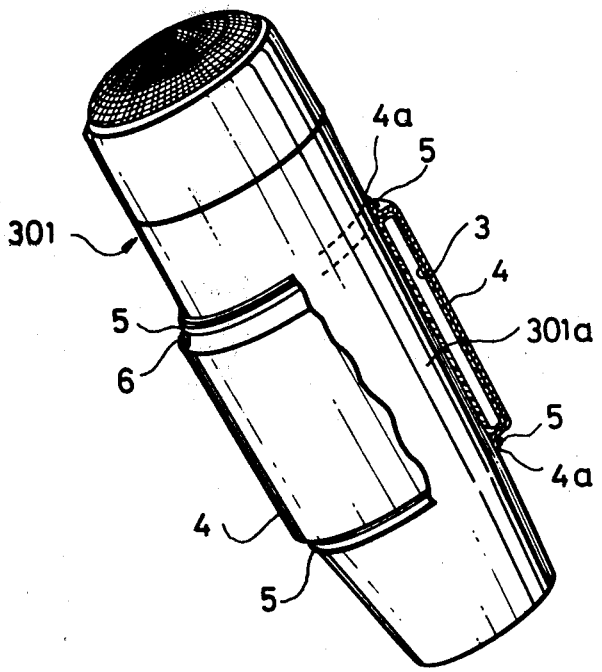
FIG. 12 is a perspective view of an electric shaver fitted with the vibration transmission preventing apparatus of the present invention in which the vibration transmission preventing apparatus is partially cut.

FIG. 12 shows an embodiment wherein the grip **301*a* of an electric shaver 301 is mounted with the vibration transmission preventing apparatus of the present invention shown in FIG. 1**.

What is claimed is:

1. In an apparatus for preventing transmission of vibration of a vibration machine, the improvement comprising a grip member of the vibration machine being constructed by a handle base portion, an air bag fitted around the outer circumference of the handle base portion, an air layer surrounding the handle base portion inside the air bag, the air bag being fitted to the handle base portion by fitting an outer cylinder to the handle base portion, the outer cylinder being secured to the handle base portion by locking means, a cylinder cover comprising inextensive flexible material loosely fitted to the outer circumference of the outer cylinder, and a plurality of air bags made of expandable material disposed in the gap between the outer cylinder and the cover, the air bags having an arcuate sectional shape and being disposed adjacent to each other in the circumferential direction of the outer cylinder.

2. In an apparatus for preventing transmission of vibration of a vibration machine, the improvement comprising a grip member of the vibration machine being constructed by a handle base portion, an air bag fitted around the outer circumference of the handle base portion, an air layer surrounding the handle base portion inside the air bag, the air bag being fitted to the handle base portion by fitting an outer cylinder to the handle base portion, the outer cylinder being secured to the handle base portion by locking means, a cylinder cover comprising inextensible flexible material loosely fitted to the outer circumference of the outer cylinder, and a plurality of air bags made of expandable material disposed in the gap between the outer cylinder and the cover, and wherein the locking means comprises a moving arcuate plate interposed between the end portion of the outer cylinder and the handle base portion and a locking bolt secured to the end portion of the outer cylinder and having its tip striking the moving arcuate plate.

3. In an apparatus for preventing transmission of vibration of a vibration machine, the improvement comprising a grip member of the vibration machine being constructed by a handle base portion, an air bag fitted around the outer circumference of the handle base portion, an air layer surrounding the handle base portion inside the air bag, a pair of support arms formed protrusively at both ends of the vibration machine to oppose each other at the same axis, a pair of support shafts fitted protrusively to the pair of support arms, respectively, opposing each other on the same line, a bag-fitting shaft as the handle base portion having a length shorter than the distance between the opposed ends of the pair of support shafts and being interposed between the pair of support shafts, a pair of connection cylinders supported at both ends of the bag-fitting shaft and having open ends, and a pair of lock rings on each of the pair of support shafts retained inside each of the open ends of the connection cylinders.

4. The apparatus as defined in claim 3 wherein each of said connection cylinders is connected to said bag-fitting shaft by a flange formed protruding inwardly at one end of each of the connection cylinders and by both ends of said bag-fitting shaft being fitted into said flanges, and a nut secured around the outer circumference at each end of said bag-fitting shaft.

5. The apparatus as defined in claim 3 wherein said pair of support shafts are provided protrusively to said pair of support arms by boring holes on said pair of support arms at the same height to oppose each other, and a nut being screwed at the protrusive end of each of said pair of support shafts inserted through each of said holes from said pair of support arms.

6. The apparatus as defined in claim 3 wherein each said connection cylinder is supported to said each support shaft by fitting said each lock ring screwed to one of the connection cylinders to said support shaft and providing a protrusive flange on the end portion of said each support shaft in said connection cylinder so as to prevent the slip-off of said lock ring out of said flange.

* * * * *